US010833428B2

(12) United States Patent
Gipson et al.

(10) Patent No.: US 10,833,428 B2
(45) Date of Patent: Nov. 10, 2020

(54) SNAP FASTENER SYSTEM FOR E-TEXTILES

(71) Applicant: Midé Technology Corporation, Woburn, MA (US)

(72) Inventors: Timothy R. Gipson, Medford, MA (US); Noel Jared Keegan, Medford, MA (US)

(73) Assignee: Mide Technology Corporation, Woburn, MA (US)

( * ) Notice: Subject to any disclaimer, the term of this patent is extended or adjusted under 35 U.S.C. 154(b) by 0 days.

(21) Appl. No.: 16/050,065

(22) Filed: Jul. 31, 2018

(65) Prior Publication Data

US 2019/0097329 A1 Mar. 28, 2019

Related U.S. Application Data

(60) Provisional application No. 62/538,928, filed on Jul. 31, 2017.

(51) Int. Cl.

| | |
|---|---|
| ***H01R 4/2425*** | (2018.01) |
| ***H01R 13/631*** | (2006.01) |
| ***H01R 13/627*** | (2006.01) |
| ***A44B 17/00*** | (2006.01) |
| *H01R 12/57* | (2011.01) |
| *H01R 101/00* | (2006.01) |

(52) U.S. Cl.

CPC ..... *H01R 4/2425* (2013.01); *A44B 17/00* (2013.01); *A44B 17/0052* (2013.01); *H01R 13/6277* (2013.01); *H01R 13/631* (2013.01); *H01R 12/57* (2013.01); *H01R 2101/00* (2013.01)

(58) Field of Classification Search

CPC ..... H01R 4/2425; H01R 13/6277; H01R 4/2433; G01R 19/14; F21V 21/002

USPC ..... 439/64

See application file for complete search history.

(56) References Cited

U.S. PATENT DOCUMENTS

| | | | | |
|---|---|---|---|---|
| 5,003,249 | A * | 3/1991 | Bird | G01R 19/14 324/122 |
| 6,079,848 | A * | 6/2000 | Ahroni | F21V 21/002 362/249.01 |
| 7,462,035 | B2 | 12/2008 | Lee et al. | |
| 8,259,460 | B2 | 9/2012 | Bhattacharya et al. | |
| 2005/0227529 | A1* | 10/2005 | Mrakovich | H01R 4/2433 439/402 |
| 2009/0161372 | A1* | 6/2009 | Fay | F21V 21/002 362/382 |
| 2010/0112842 | A1 | 5/2010 | Machado et al. | |
| 2016/0181729 | A1 | 6/2016 | Barth et al. | |

* cited by examiner

*Primary Examiner* — Jean F Duverne

(74) *Attorney, Agent, or Firm* — Iandiorio Teska & Coleman, LLP

(57) ABSTRACT

A snap fastener system includes a conductive first snap fastener portion in electrical and physical contact with a first electronic component, a second snap fastener portion, and a snap ring including tines mated to one of the first and/or second snap fastener portions and including one or more conductive insulation displacement tines which cut through the insulation covering a wire to be electrically coupled to the first electronic component.

29 Claims, 15 Drawing Sheets

SNAP FASTENER SYSTEM FOR E-TEXTILES

RELATED APPLICATIONS

This application claims benefit of and priority to U.S. Provisional Application Ser. No. 62/538,928 filed Jul. 31, 2017, under 35 U.S.C. §§ 119, 120, 363, 365, and 37 C.F.R. § 1.55 and § 1.78, and is incorporated herein by this reference.

FIELD OF THE INVENTION

This subject invention relates to wearable electronics and fasteners.

BACKGROUND OF THE INVENTION

Wearable electronics are facilitated by electrically active fabrics, i.e. e-textiles, which embed electrical conductors into the textile and provide a means for connecting said conductors to electronic devices and each other. These devices may include decorative displays, phone chargers, haptic devices, fitness trackers and sensors, medical devices, etc.

Such a connection is often achieved via a fastener or closure, such as a magnetic clasp, hook-and-loop fastener, screw fastener, snap or popper. This connection presents a difficulty, then, in electrically connecting the fastener or closure to an e-textile conductor.

Several methods have been tried and are known in the art, such as the use of conductive thread or fabric, or soldering or crimping a conductor wire to the fastener. However, conductive threads and fabrics are generally expensive or have high resistivity, making them unsuitable for many applications, as well as longevity and robustness issues such as breakage of the conductive fibers or fraying, which causes short circuits between neighboring conductive thread traces. Crimp or solder connections require an uninsulated portion of wire and typically manual labor to make the connection which becomes costly if many such connections must be made. Likewise, each exposed crimp or solder connection becomes a weak point and a possible point of failure. The labor increases if multiple connections must be made at intervals to the same insulated conductor, such as a common power or ground conductor, since the conductor must be broken or the insulation otherwise stripped at each interval to make the connection. None of these connection methods is ideally amenable to mass production via machine assembly.

BRIEF SUMMARY OF THE INVENTION

Featured is a snap fastener system including a conductive first snap fastener portion in electrical and physical contact with a first electronic component, a second snap fastener portion, and a snap ring including tines mated to one of the first and/or second snap fastener portions and including one or more conductive insulation displacement tines which cut through the insulation covering a wire to be electrically coupled to the first electronic component.

In one embodiment, the first snap fastener portion may include a stud, the second snap fastener portion may include a snap ring receptacle including a conductive socket receiving the first fastener portion stud therein, and the snap ring may be mated to the snap ring receptacle. The first snap fastener portion may include a conductive socket, the second snap fastener portion may include a stud received in the conductive socket of the first snap fastener portion, and the snap ring may be mated to the second snap fastener portion. The first electronic component may be a printed circuit board soldered to the conductive first fastener portion. The snap ring receptacle may include a passage threrethrough receiving the snap ring tines. The snap ring receptacle may be located over the wire and the snap ring may be located under the wire. The wire may be associated with a fabric and the snap ring tines may pierce through the fabric physically capturing the fabric between the snap ring receptacle and snap ring. The second snap fastener portion may include a passage threrethrough receiving the snap ring tines. The snap ring receptacle may be located over the wire and the snap ring mat be located under the wire. The wire may be associated with a fabric and the snap ring tines may pierce through the fabric physically capturing the fabric between the snap ring receptacle and snap ring. The insulation displacement tines may include spaced knife edges on each side of a channel sized to receive the wire therein. The edges of the tines may be angled and coverage towards the channel. The insulation displacement tines may be configured to pierce the insulation covering the wire to be electrically coupled to the first electrical component. The snap fastener system may include two opposing insulation displacement tines. The snap fastener system may include a cover about the snap ring. The cover may include at least one recess for receiving the wire therein. The snap fastener system may include a cover about the snap ring. The cover may include at least one recess for receiving the wire therein. The one or more conductive insulation displacement tines may be configured to receive wires of different gauges. The snap fastener system may include a conductive second snap fastener portion electrically isolated from the conductive first snap fastener portion and in electrical and physical contact with the first electrical component. The snap fastener system may include a center insulation displacement connector electrically isolated from the snap ring and/or the first snap fastener portion including one or more conductive insulation displacement tines which cut through the insulation covering a second wire to be electrically coupled to the first electrical component. The snap fastener portion may include one or more conductive foot or feet configured to reduce contact area on the first electronic component. The snap fastener portion may include one or more conductive foot or feet configured to provide for surface trace routing from beneath the snap fastener position. The conductive first snap fastener portion may include an alignment key configured to prevent rotation of the conductive snap ring portion disposed in surface mount technology (SMT) tape. The second snap fastener portion may include an alignment key configured to prevent rotation of the conductive snap ring portion disposed in SMT tape. The snap ring may include an alignment key configured to prevent rotation of the conductive snap ring portion disposed in SMT tape.

Featured is a method of manufacturing a snap fastener system, the method including providing a conductive first snap fastener portion in electrical and physical contact with a first electrical component, providing a second snap fastener portion, providing a snap ring including one or more tines mated to one of the first and/or second snap fastener portions and including one or more conductive insulation displacement tines which cut through the insulation covering a wire to be electrically coupled to the first electronic component, and providing overlay tape to a circumferential edge of the second snap fastener portion configured to be received by a vacuum pickup system.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
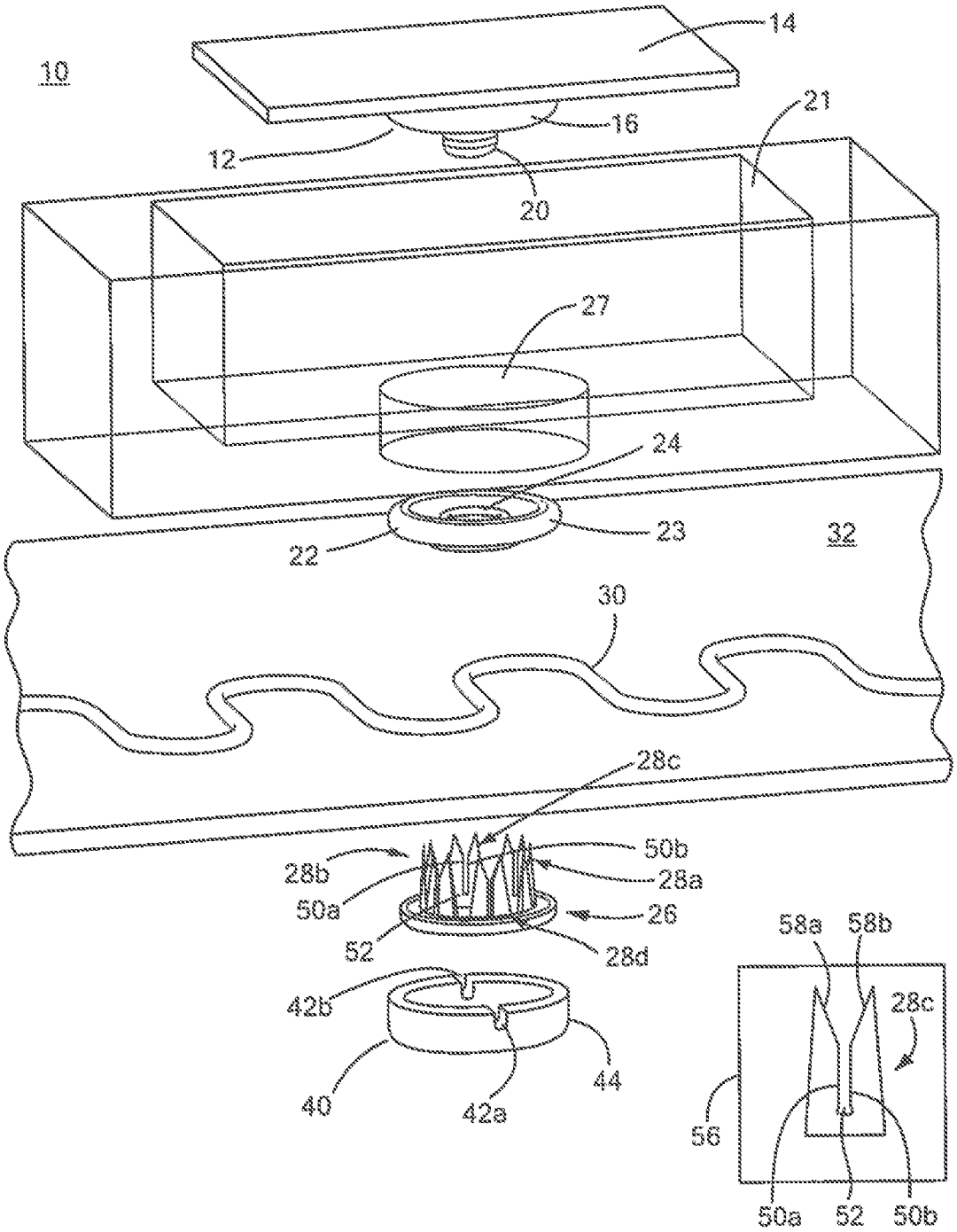
FIG. 1 is an exploded view of one example of the snap fastener system for E-textiles.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Disclosed herein is a fabric closure incorporating an integral insulation-displacement feature for electrical connection of an unbroken insulated wire without prior removal or other treatment of the wire insulation ideally including a strain relief and wire retention feature.

A typical insulation-displacement closure mechanism preferably includes an attachment unit and a closure unit, as in a typical snap closure, with at least one insulation-displacement connector feature built into at least one of these units for electrically connecting to an insulated wire. In a preferred embodiment, the insulation-displacement closure mechanism would typically also include an insulation displacement connector acceptance feature, for accepting (e.g., providing passage of or space for) the insulation displacement contact (IDC) feature without compromising its electrical connection; a wire retention feature for securing a wire to the active portion of an IDC feature and preventing removal of the wire; and a wire acceptance feature for accepting (providing passage of or space for) a wire, including insulation, without damaging said wire or compromising the attachment of the snap assembly to the garment, and which may also serve as a wire guide feature.

As in a typical snap closure, an attachment unit and closure unit are mechanically and nonremovably affixed to one another by a design feature for this purpose. Affixing the attachment unit and closure unit simultaneously captures an insulated wire, electrically connects to said wire via insulation displacement, and affixes the snap to a substrate (typically fabric or other material comprising a wearable garment) by capturing a portion of said substrate.

In a typical application, an IDC snap closure assembly would mate with a mating assembly comprising either another IDC snap closure assembly, a conventional snap assembly, or a mating closure unit disposed on an electronic device. In the latter case, the closure unit would typically be recessed in or protrude from the device enclosure, and may consist of any suitable mating closure unit, including an IDC snap assembly, conventional snap assembly, or closure unit directly soldered to a PCB, and the like.

Figure 2:
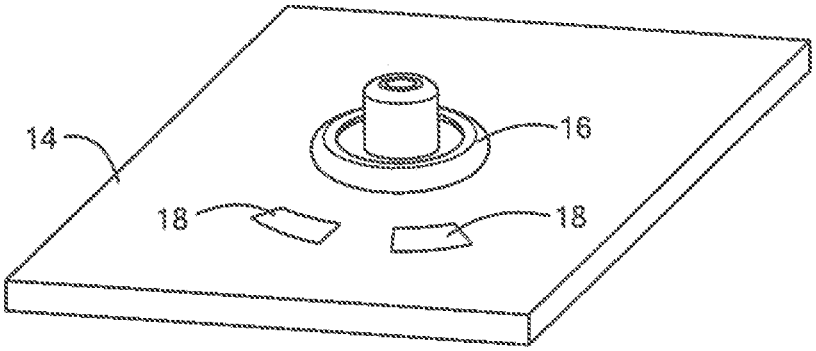
FIG. 2 shows one example of the snap stud shown in FIG. 1 in position to be soldered to a primed circuit board (PCB)
Figure 3:
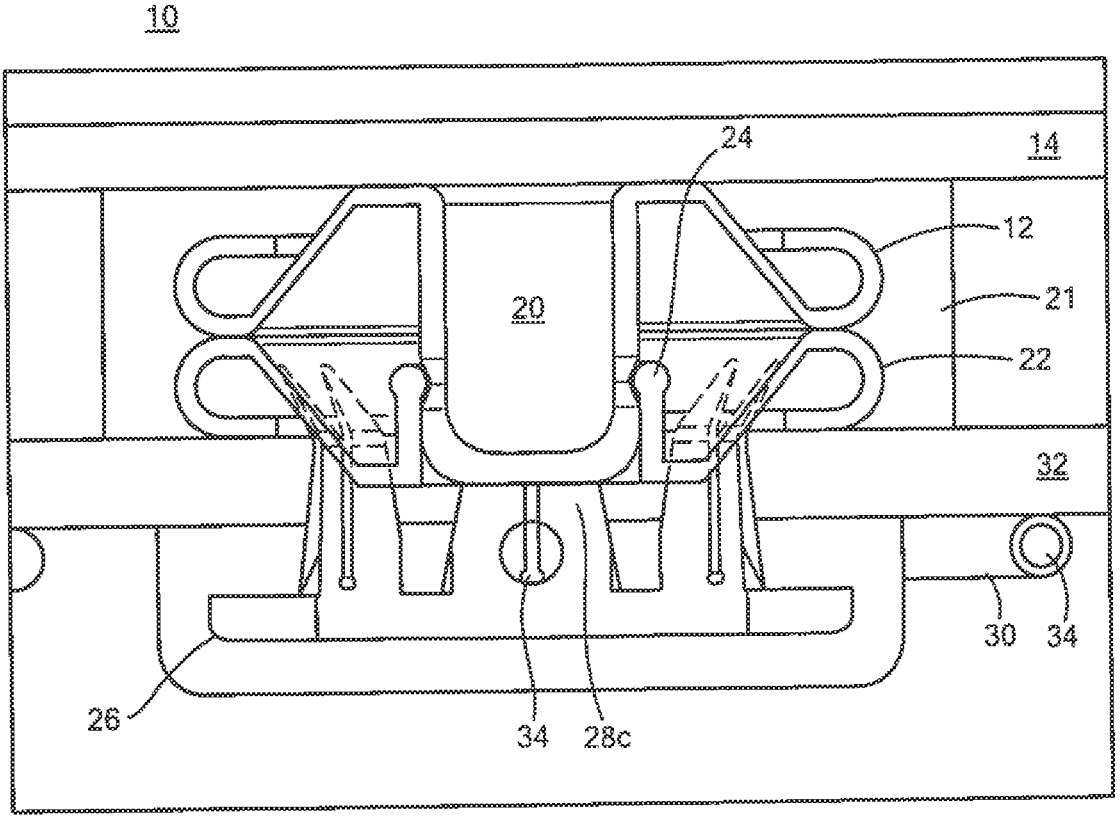
FIG. 3 is a cross section view of one example of the snap fastener system shown in FIGS. 1-2 in its assembled configuration.

FIGS. 1-4 show an example of a snap fastener system 10 with conductive first snap fastener portion, e.g., conductive male portion 12, in electrical and physical contact with electronic component 14, e.g., a printed circuit board (PCB) or similar type electronic component. The top 16 of male portion 12 may be soldered (e.g., using surface mount technologies) to lands 18 of PCB 14 shown in FIG. 2. Stud 20 depends from male portion 12. Snap fastener system 10 also includes second snap fastener portion, e.g., snap ring receptacle 22, with conductive socket 24 which receives therein via a friction fit stud 20 of male portion 12. PCB 14 may be included in a device housing 21 with opening 27 through which stud 20 extends. In one design, snap fastener system 10 also includes snap ring 26 mated to snap ring receptacle 22. Snap ring 26 includes tines 28*a*, 28*b* and the like, one or more of which are configured as conductive insulation displacement tines 28*c*, 28*d* shaped to cut through the insulation 30 covering a wire 34, FIG. 3, shown here embedded in or otherwise associated with fabric 32.

Figure 4:
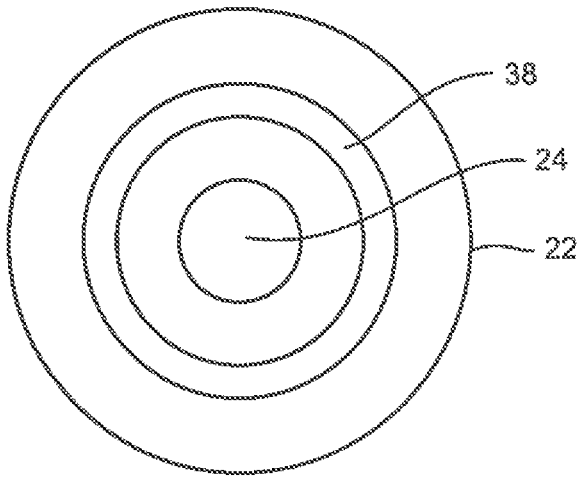
FIG. 4 is a top view of the snap ring receptacle shown in FIG. 1.

Typically, snap ring receptacle 22, FIG. 4, includes a passage 38 around socket 24 receiving snap ring tines 28 therethrough which are then bent outwards as shown in FIG. 3 to mate the snap ring receptacle to the snap ring. In another example, the tines 28 bend under curved rim 23, FIG. 2, of receptacle 22.

Thus, the electrical connection between lands 18, FIG. 2 of PCB to wire 34, FIG. 3, is via male portion 12, stud 20, socket 24 of snap ring receptacle 22, and tines 28*c*, 28*d* which contact wire 34.

In this particular embodiment, snap ring 26 is located on one side of fabric 32 and snap ring receptacle 22 is located on the other side of the fabric and tines 28 are driven through the fabric thus physically capturing the fabric between snap ring receptacle 22 and snap ring 26. In this way, PCB 14 can be easily moved from and attached to fabric 32 in order to make electrical contact with one or more of the wires embedded therein.

Cover 40 (made of a nonconductive protective material such as rubber) may be included about (e.g., overmolded) snap ring 26 and may include one or more opposing recesses 42*a*, 42*b* in side wall 44 to capture the wire and further insulate the snap ring 26.

Figure 5:
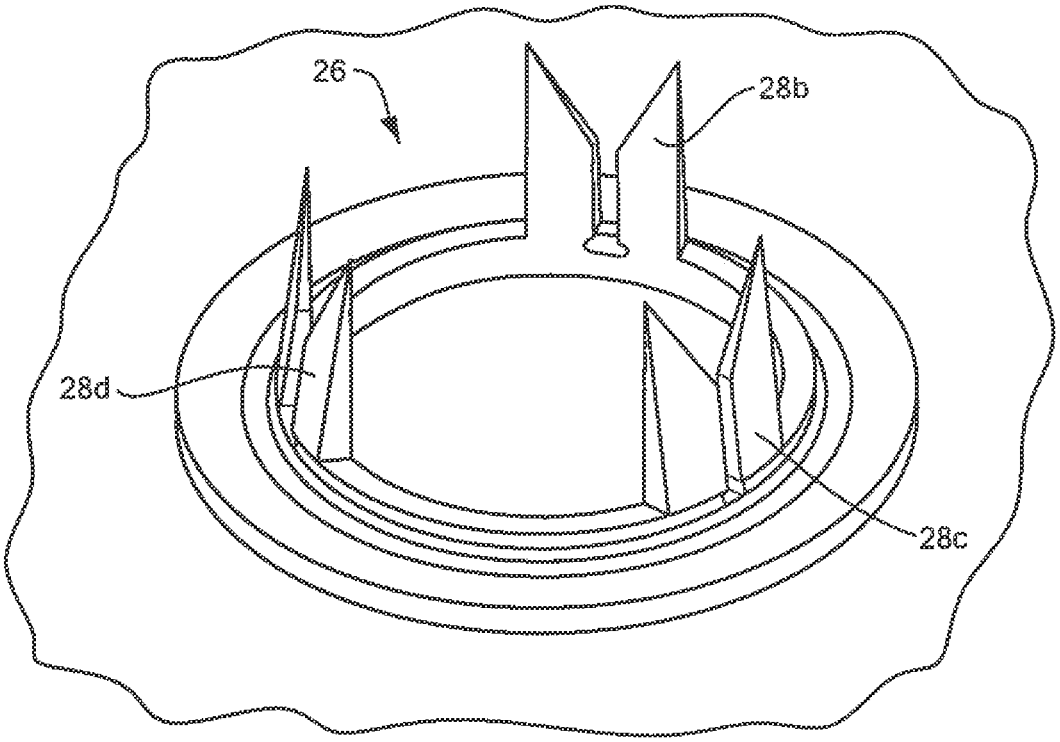
FIG. 5 is a schematic view showing one example of insulation displacement tines shown in one or more of FIGS. 1-3 configured to receive wires of different gauges.

The insulation displacement tines may include spaced knifed edges 50*a*, 50*b*, FIG. 1, on each side of channel 52, shown in greater detail in caption 56, sized to receive the wire therein. As shown in caption 56, the inside edges 58*a*, 58*b* are angled outwardly and converge towards channel 52. The insulation of the wire is guided by the upward V-shaped portion of edges 58*a*, 58*b* of channel 52 and the interior knife edges 50*a*, 50*b* cut through the insulation of the wire which then contacts wire 34, as discussed above. The width of channel 52 thus corresponds closely to the diameter or gauge of the wire or wires within the insulation. In one design, the conductive insulation displacement tines 28*c*, 28*d*, FIG. 1, may be configured to receive wires of different gages, e.g., conductive insulation displacement tines 28*b*, 28*c*, and 28*d*, FIG. 5.

Figure 6A:
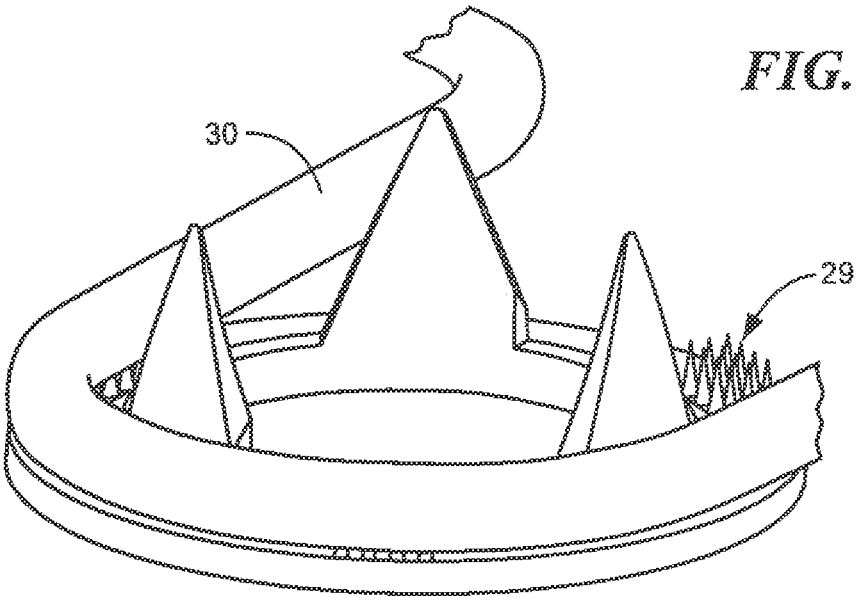
FIGS. 6A, 6B, and 6C is a schematic view showing one example of insulation displacement tines shown in one or more of FIGS. 1-3 configured to pierce the insulation in the wire.
Figure 6B:
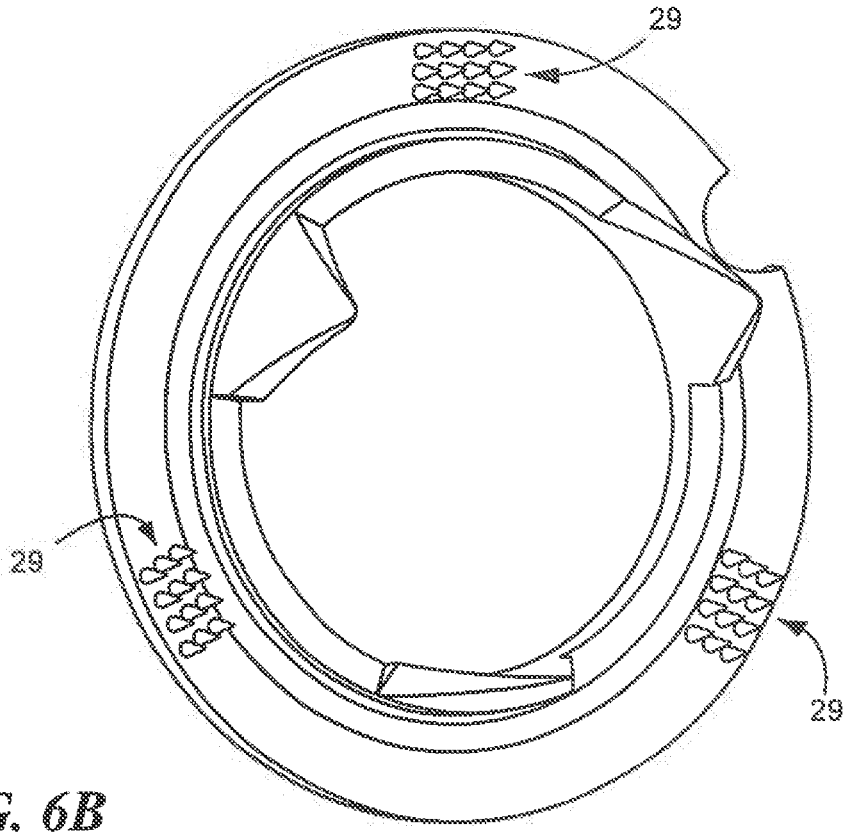
Figure 6C:
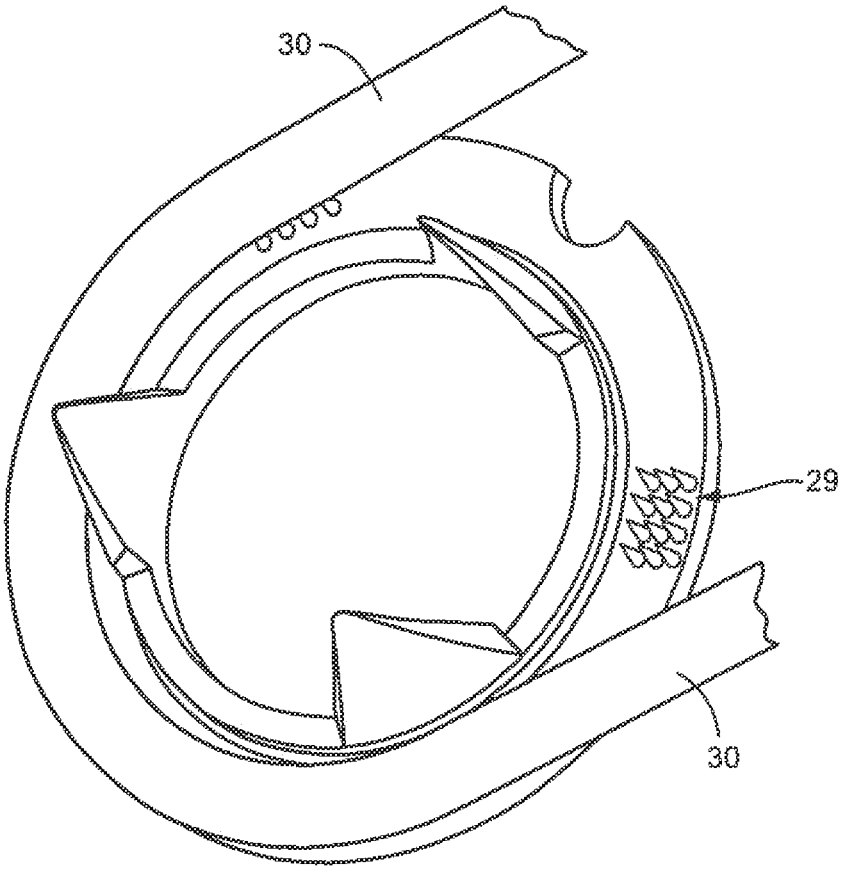

In another design, the insulation displacement tines may be configured to pierce the insulation covering the wire to be electrically coupled to the first electrical component. For example, FIGS. 6A, 6B, and 6C show examples of insulation displacement tines 29 configured to pierce insulation 30, FIG. 1, and electrically couple wire 34, FIG. 3, to PCB 14.

Figure 7:
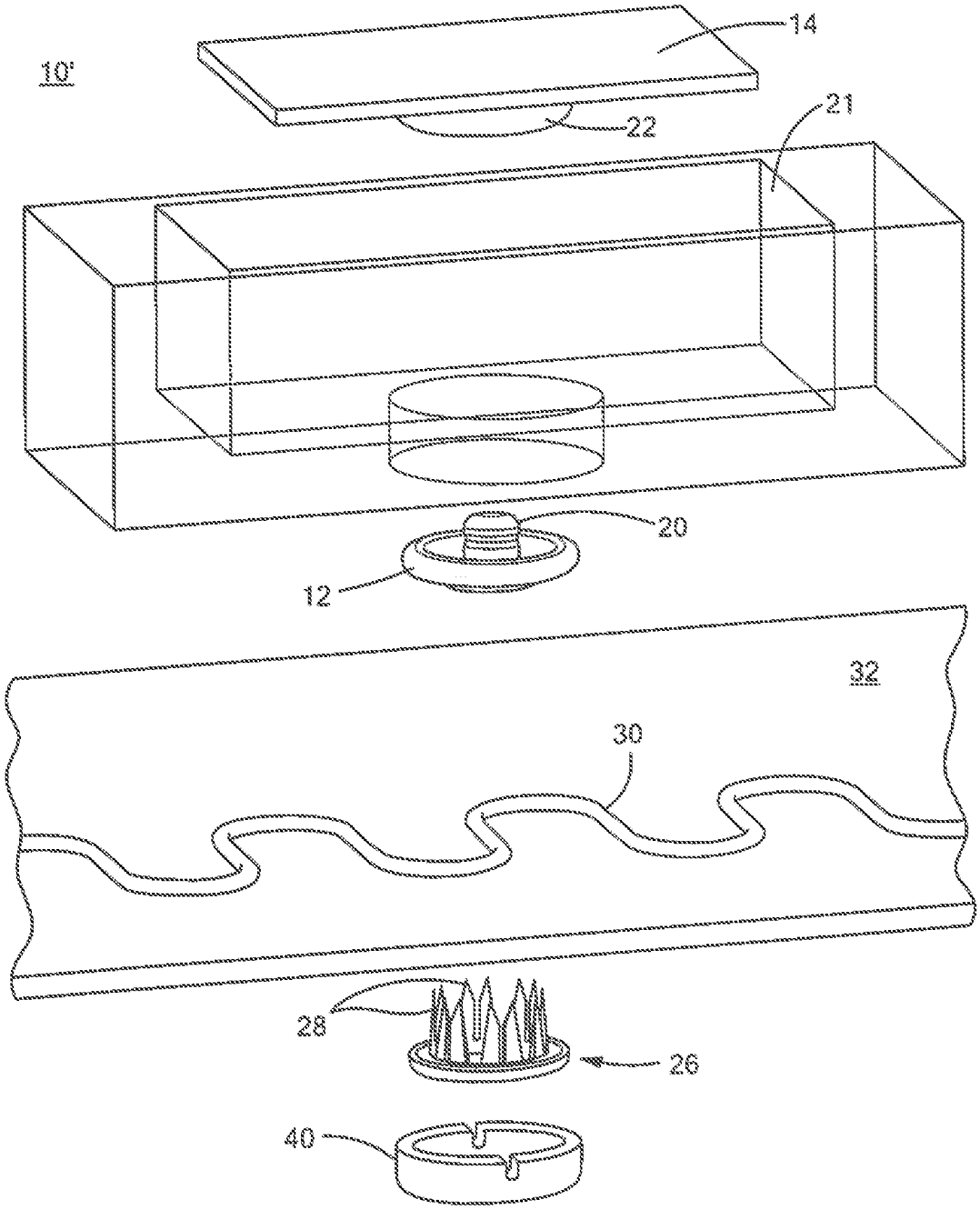
FIG. 7 is an exploded view of another embodiment of a snap fastener system.
Figure 8:
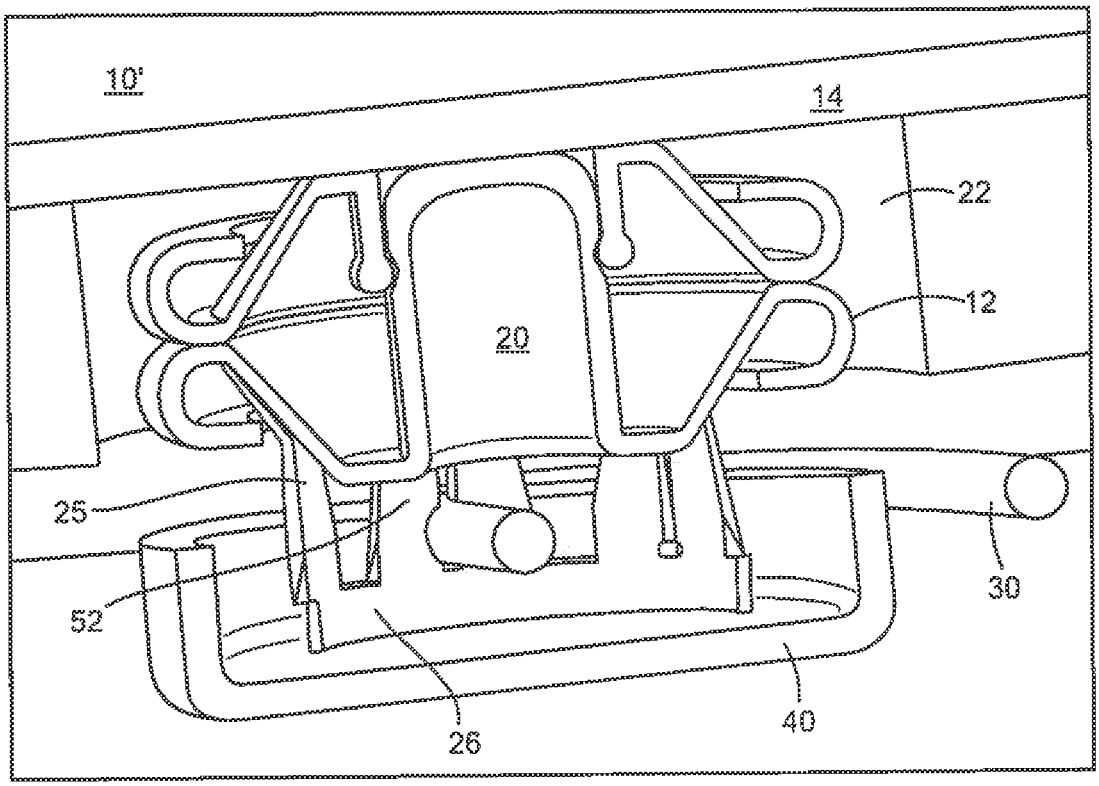
FIG. 8 is a cross section view of one example of the snap fastener system shown in FIG. 7 in its assembled configuration.

FIGS. 7 and 8 show an example of another embodiment of snap fastener system 10' where the second snap fastener portion, snap ring receptacle 22, is mounted to PCB 14 and snap stud 12 is mated to snap ring 26 capturing fabric 32 between snap stud 12 and snap ring 26. Here, the tines 25, including one or more conductive insulation displacement tines as discussed above with reference to FIG. 1, of the snap ring 26 bend along outer wall 53, FIG. 8, of snap stud 12 and under curved surface 55.

Figure 9:
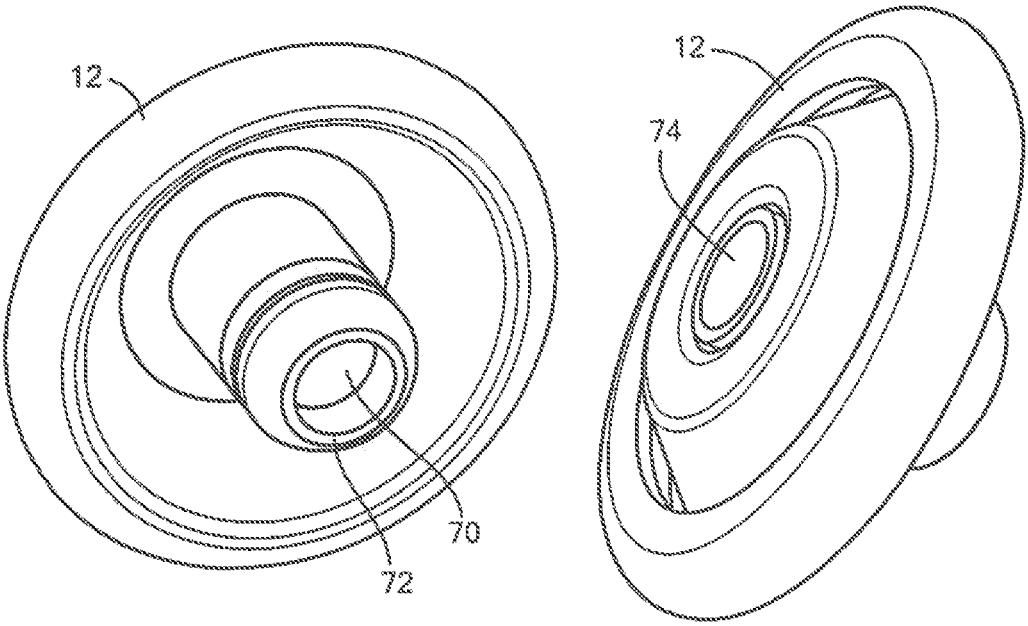
FIG. 9 is a three-dimensional view showing an example of the snap fastener system shown in one or more of FIGS. 1-8 including a conductive second snap fastener portion.
Figure 10:
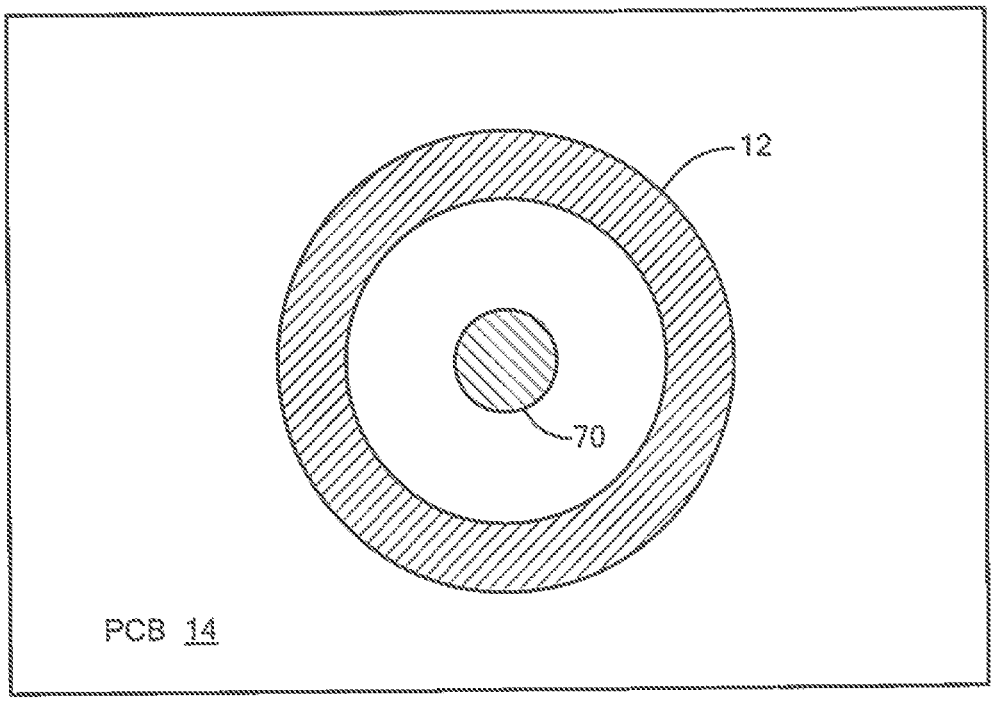
FIG. 10 is a top view showing one example of the electrical connections of the conductive first snap fastener portion and the conductive second snap fastener to a PCB.

In one design, snap fastener system 10 shown in one or more of FIGS. 1-8 preferably includes conductive second snap fastener portion 70, FIG. 9, which is electrically isolated from conductive first snap fastener portion or male portion 12. In one design, insulation ring 72, made of a non-electrically conductive material such as plastic or similar type material, may be used to electrically isolate conductive second snap fastener portion 70 from conductive male portion 12. Conductive second snap fastener portion 70 is preferably configured as a stud as shown and is made of an electrically conductive material, e.g., a metal material, such as stainless steel or similar type metal material and may optionally include a nonreactive plating, e.g., gold, or similar type metal, to provide electrical and physical contact with first electronic component 14, FIG. 1, e.g., a PCB or similar type device, via surface 74, FIG. 9, of conductive second snap fastener portion 70. FIG. 10 shows an example of the layout of conductive male portion 12 and conductive second snap fastener portion 70 on PCB 14.

Figure 11:
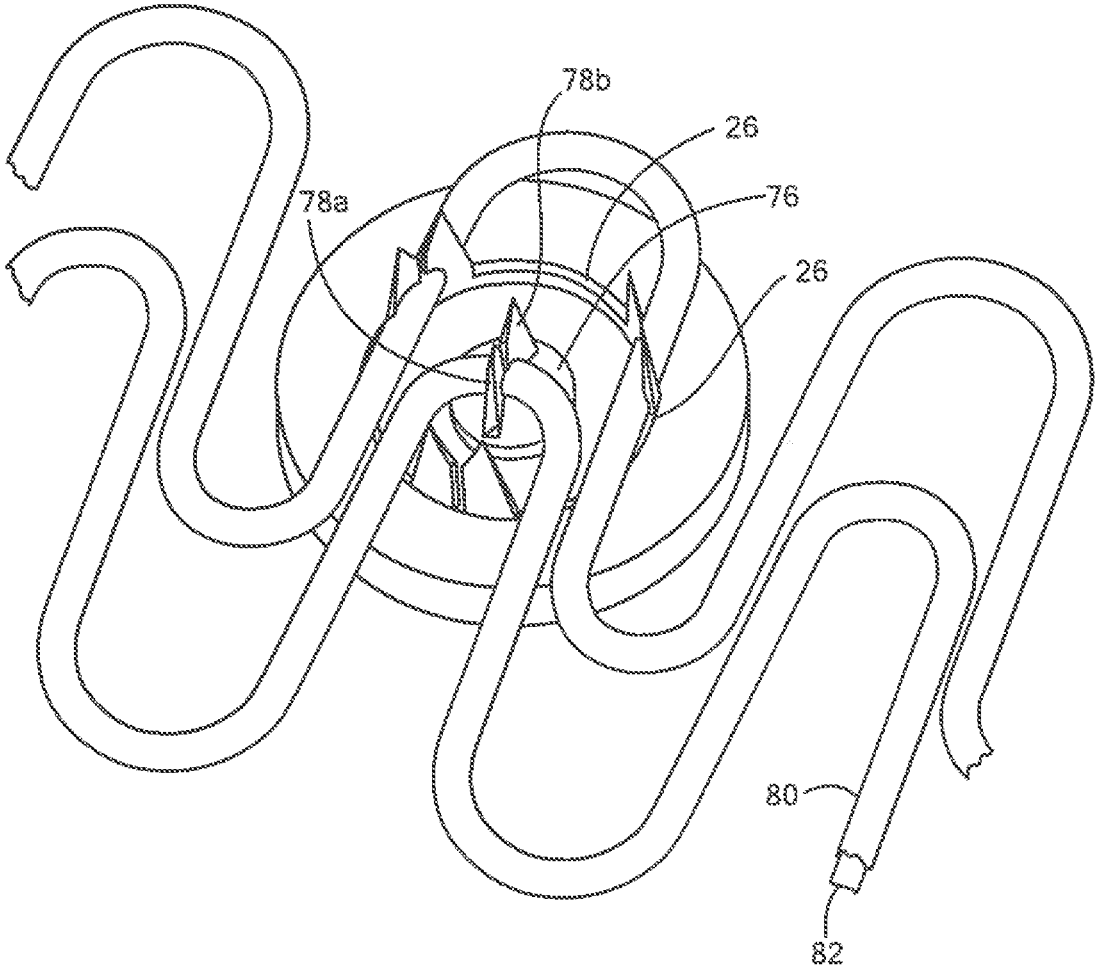
FIG. 11 is a three-dimensional top view showing one example of the snap fastener system shown in one or more of FIGS. 1-7 including a center insulation displacement connector coupled to a second wire.
Figure 12:
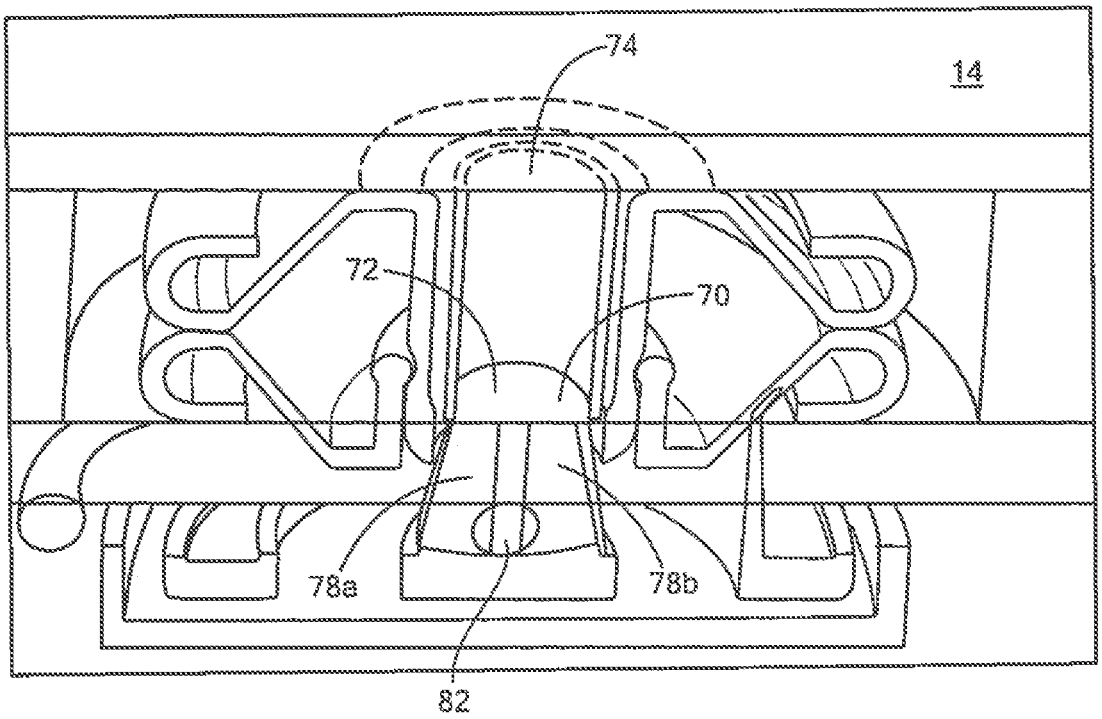
FIG. 12 is a cross section view of one example of the snap fastener system shown in FIGS. 9-11 its assembled configuration.

Snap fastener system 10 also preferably includes center insulation displacement connector 76, FIG. 11, electrically isolated from snap ring 26 as shown, e.g., with a non-electrically conductive material. Center insulation displacement connector 76 preferably includes one or more conductive insulation displacement tines 78*a*, 78*b*, of similar design to conductive insulation displacement tines 28*c*, 28*d* discussed above with reference to FIG. 1, which cut through the insulation 80 covering second wire 82, FIG. 12, to electrically couple wire 82 to the first electronic component, e.g., PCB 14. In one design, one or more conductive insulation displacement tines 78*a*, 78*b*, FIGS. 11 and 12, coupled to wire 82 contact surface 72, FIG. 9, of conductive second snap fastener portion 70 to electrically coupled wire 82 to PCB 14.

Figure 13A:
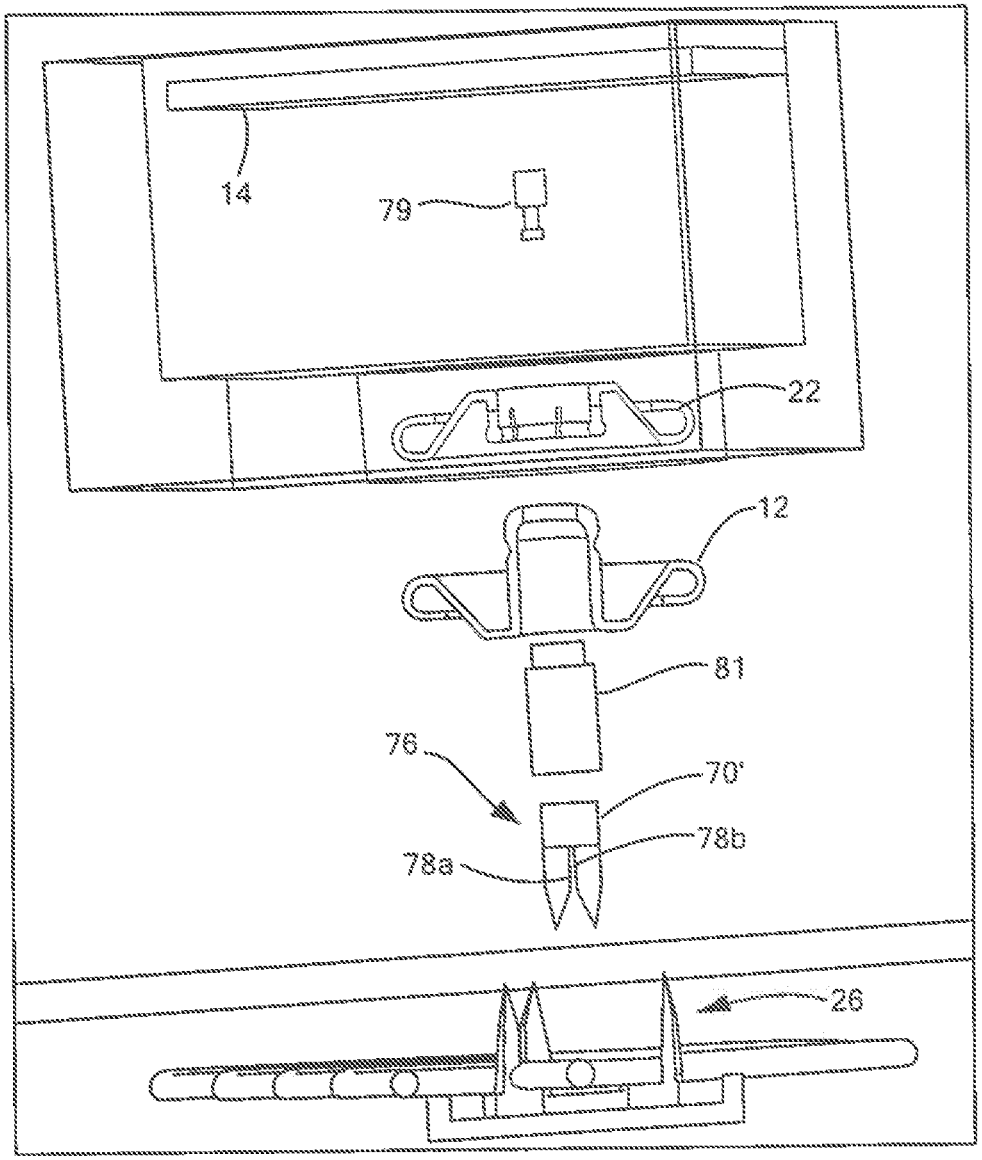
FIGS. 13A to 13D show exploded views of another embodiment of a snap fastener system shown in FIGS. 9-12.
Figure 13B:
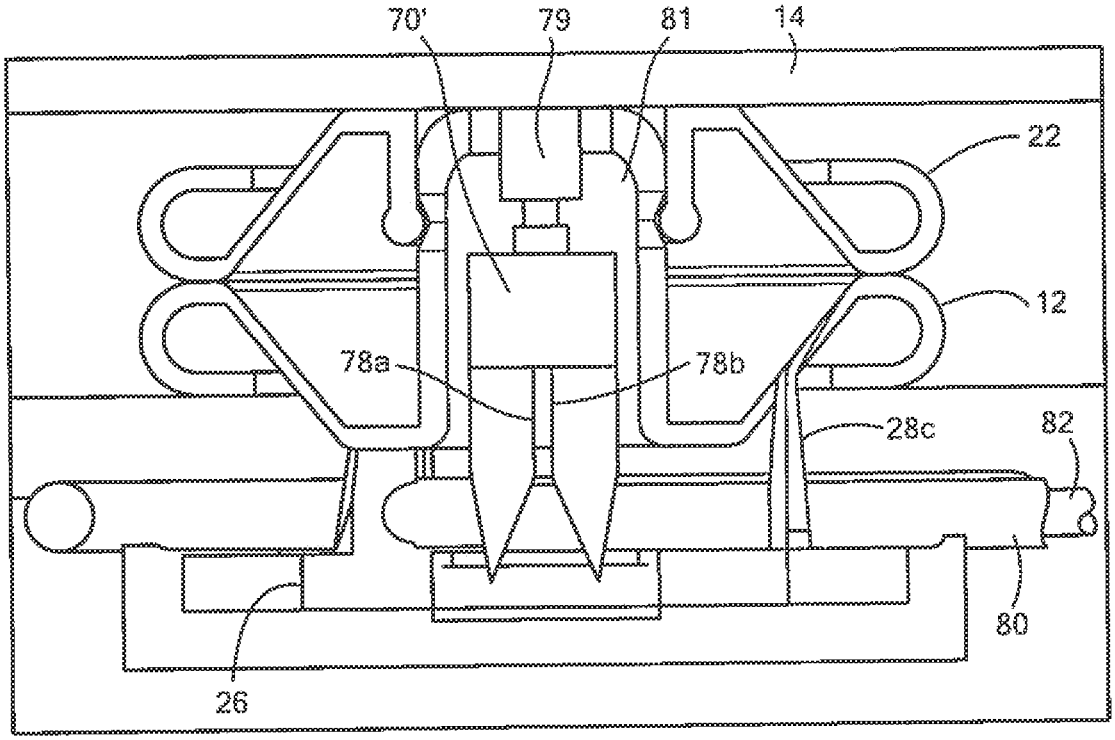
Figure 13C:
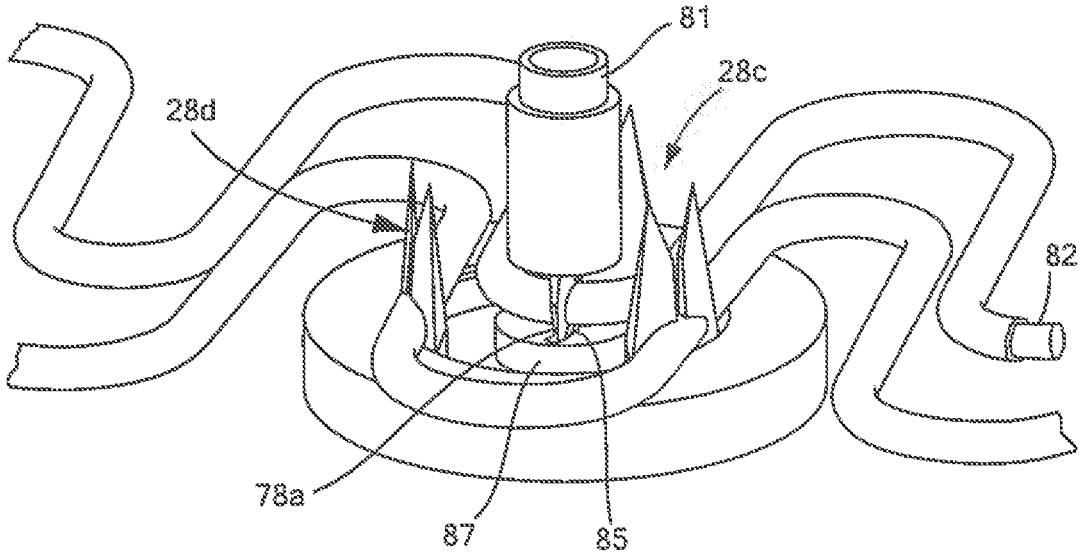
Figure 13D:
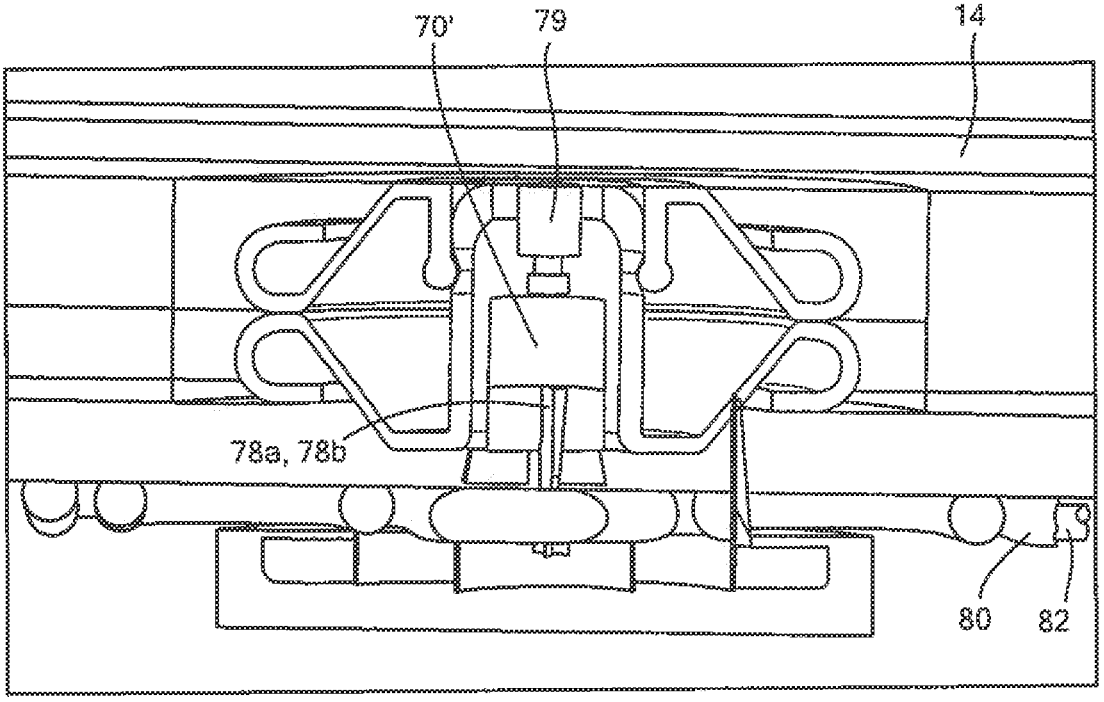

In another embodiment, conductive second snap fastener portion 70', FIG. 13A, may be integrated with center insulation displacement connector 76, which in this design includes one or more conductive insulation displacement tines 78*a*, 78*b*. Conductive second snap fastener portion 70 electrically and physically contacts PCB via pogo pin 79, e.g. as shown in FIG. 13B. In this example, conductive second snap fastener portion 70' is electrically isolated from snap ring 26 and conductive first snap fastener portion 12 by electrically insulating sleeve 81, shown in greater detail in FIG. 13A, made of a non-electrically conducting material, such as plastic or similar non-electrically conducting material. Conductive insulation displacement tines 78*a*, 78*b* preferably insert into groove 85, FIG. 13C, in mount 87. Mount 87 is electrically isolated from snap ring 26 as shown. Thus, second wire 82, inside insulation 80 is electrically coupled to PCB 14 by the connection of conductive insulation displacement tines 78*a*, 78*b* to wire 82, second snap fastener portion 70' to pogo-pin 79, and pogo-pin 79 to PCB 14, e.g., as shown in FIGS. 13A-13D.

Figure 14B:
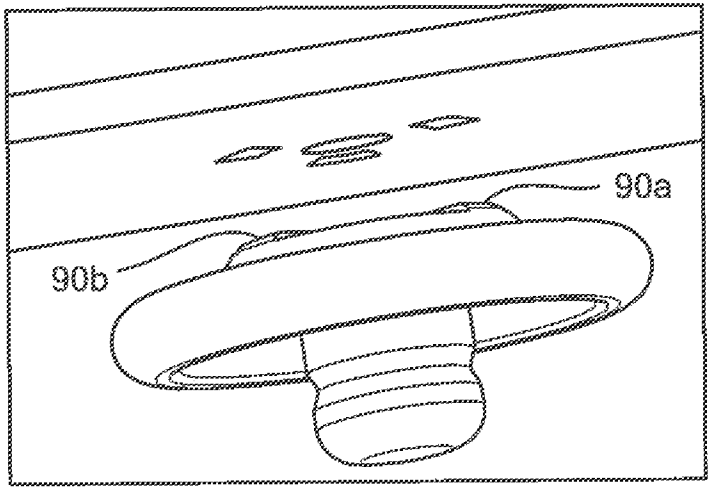
FIG. 14A and 14B are three-dimensional views showing examples of raised conductive feet on the conductive first snap fastener portion shown in one or more of FIGS. 1-13D configured to minimize contact area on the first electronic component.
Figure 14A:
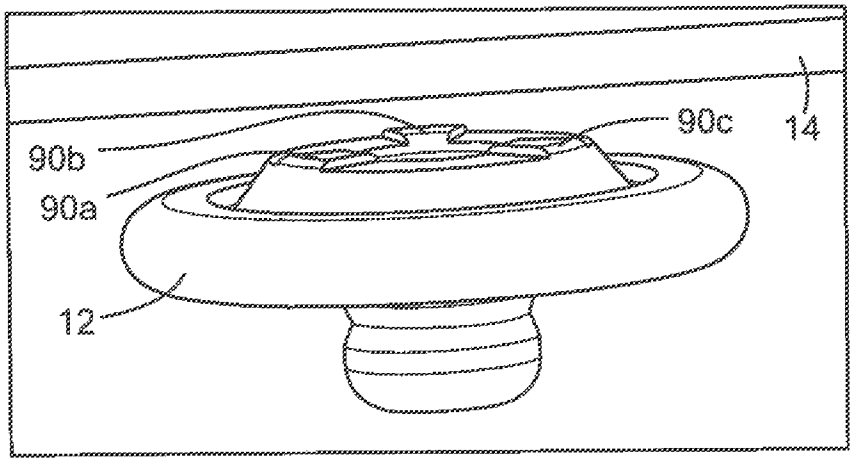
Figure 14C:
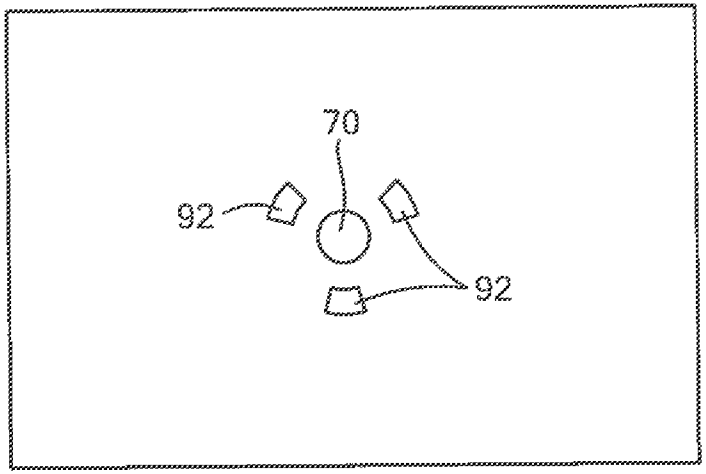
FIG. 14C is a schematic, top view showing the contact area of the raised conductive feet shown in FIGS. 14A and 14B.

In one design, conductive first snap fastener portion, e.g., conductive male portion 12 shown in one more of FIGS. 1-13D may include one or more conductive foot or feet, e.g., conductive feet 90*a*, 90*b*, 90*c*, FIGS. 14A, and 14B, which are preferably raised as shown, and configured to reduce the contact area on PCB 14 and provide for surface trace routing on the PCB surface beneath the snap fastener portion. FIG. 14C shows one example of the minimized contact area, indicated at 92, where in this example, conductive male portion 12 includes three conductive raised feet 90*a*, 90*b*, and 90*c*. In this example, the connection for conductive second snap fastener portion 70 is also shown. The contact area minimization may also include a depression or aperture in an otherwise uniformly raised contact feature. In other examples, conductive male portion 12 shown in one more of FIGS. 1-13D may include just one. conductive foot, e.g., conductive foot 90*a*, 90*b*, or 90*c*, FIGS. 14A-14B.

Figure 15:
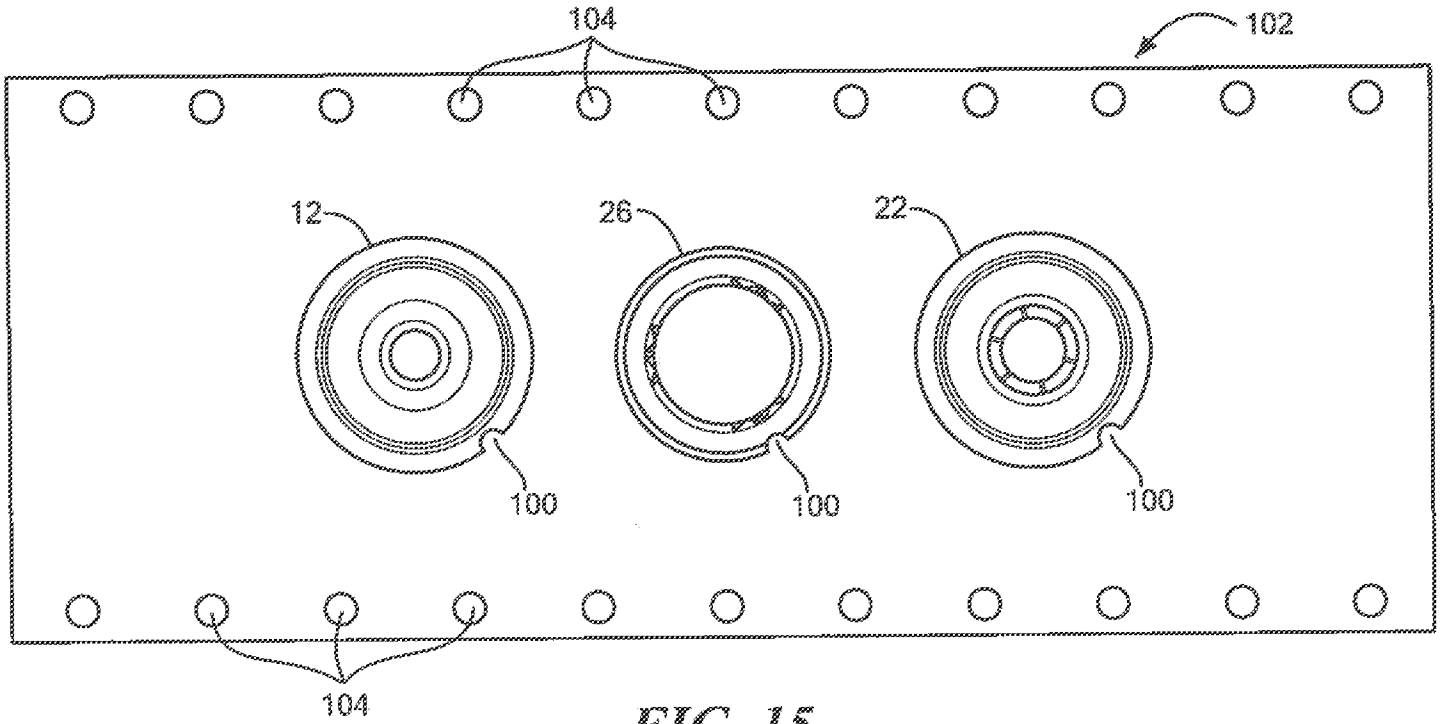
FIG. 15 is a top view showing examples of an alignment keys or tabs configured to prevent rotation of the conductive first snap fastener portion, the second snap fastener portion, and/or the snap ring shown in one or more of FIGS. 1-14C.

In one example, one or more of conductive first snap fastener portion, male portion 12, second snap fastener portion, snap ring receptacle 22, and/or snap ring 26, shown in one or more of FIGS. 1-13D may include an alignment key to prevent rotation when disposed in surface mount technology (SMT) tape. FIG. 15 shows one example of alignment key or tab 100, in conductive male portion 12 and/or snap ring receptacle 22, and/or snap ring 26 disposed in SMT tape 102 having machine holes 104. As shown, alignment key or tab 100 preferably prevents rotation of conductive male portion 12, snap ring receptacle 22, and/or snap ring 26 when disposed in SMT tape 100.

Figure 16:
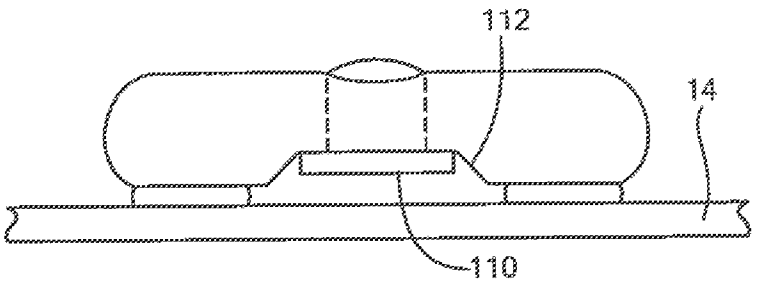
FIG. 16 is a schematic side view showing one example of overlay tape placed on the conductive first snap fastener portion for use with a method of manufacturing the snap fastener system for E-textiles.

In one example, the method of manufacturing a snap fastener system 100 shown in one or more of FIGS. 1-15 may include attaching overlay tape 110, FIG. 16. to circumferential edge 112 of second snap fastener portion 22. Overlay tape, e.g., a tape made of polyimide or similar type material is preferably configured to be received by a vacuum pickup system, as known by those skilled in the art.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

What is claimed is:

1. A snap fastener system for a fabric article with one or more insulated wires embedded therein, the system comprising:

a conductive first snap fastener portion in electrical and physical contact with a first electronic component;

a second snap fastener portion snap mateable to the first snap fastener portion; and a snap ring including tines mated to one of the first and/or second snap fastener portions about the fabric article and including one or more conductive insulation displacement tines which pierce through the fabric and cut through the insulation covering a said wire to be electrically coupled to the first electronic component.

2. The snap fastener system of claim 1 in which the first snap fastener portion includes a central stud, the second snap fastener portion includes a snap ring receptacle including a conductive central socket receiving the first fastener portion central stud therein, and the snap ring is mated to the snap ring receptacle.

3. The snap fastener system of claim 1 in which the first snap fastener portion includes a central conductive socket, the second snap fastener portion includes a central stud received in the central conductive socket of the first snap fastener portion, and the snap ring is mated to the second snap fastener portion.

4. The snap fastener system of claim 1 in which the first electronic component is a printed circuit board soldered to the conductive first fastener portion.

5. The snap fastener system of claim 2 in which the snap ring receptacle includes a passage therethough receiving the snap ring tines.

6. The snap fastener system of claim 2 in which the snap ring receptacle is located over the wire and the snap ring is located under the wire.

7. The snap fastener system of claim 2 in which the snap ring tines physically capture the fabric between the snap ring receptacle and snap ring.

8. The snap fastener system of claim 3 in which the second snap fastener portion includes a passage therethough receiving the snap ring tines.

9. The snap fastener system of claim 3 in which the snap ring receptacle is located over the wire arid the snap ring is located under the wire.

10. The snap fastener system of claim 3 in which the snap ring tines physically capture the fabric between the snap ring receptacle and snap ring.

11. The snap fastener system of claim 1 in which the insulation displacement tines includes spaced knife edges on each side of a channel sized to receive the wire therein.

12. The snap fastener system of claim 8 in which edges of the tines are angled and coverage towards the channel.

13. The snap fastener system of claim 1 in which the insulation displacement tines are configured to pierce the insulation covering the wire to be electrically coupled to the first electrical component.

14. The snap fastener system of claim 1 in which there are two opposing insulation displacement tines.

15. The snap fastener system of claim 2 further including a cover about the snap ring.

16. The snap fastener system of claim 11 in which the cover includes at least one recess for receiving the wire therein.

17. The snap fastener system of claim 3 further including a cover about the snap ring.

18. The snap fastener system of claim 3 in which the cover includes at least one recess for receiving the wire therein.

19. The snap fastener system of claim 1 in which the one or more conductive insulation displacement tines are configured to receive wires of different gauges.

20. The snap fastener system of claim 1 further including conductive second snap fastener portion electrically isolated from the conductive first snap fastener portion and in electrical and physical contact with the first electrical component.

21. The snap fastener system of claim 20 further including a center insulation displacement connector electrically isolated from the snap ring and/or the first snap fastener portion including one or more conductive insulation displacement tines which cut through the insulation covering a second wire to be electrically coupled to the first electrical component.

22. The snap fastener system of claim 1 in which the snap fastener portion includes one or more conductive foot or feet configured to reduce contact area on the first electronic component.

23. The snap fastener system of claim 1 in which the snap fastener includes one or more conductive foot or feet configured to provide for surface trace routing from beneath the snap fastener portion.

24. The snap fastener system of claim 1 in which the conductive first snap fastener portion includes an alignment key configured to prevent rotation of the conductive snap ring portion disposed in surface mount technology (SMT) tape.

25. The snap fastener system of claim 1 in which the second snap fastener portion includes an alignment key configured to prevent rotation of the conductive snap ring portion disposed in SMT tape.

26. The snap fastener system of claim 1 in which the snap ring includes an alignment key configured to prevent rotation of the conductive snap ring portion disposed in SMT tape.

27. The method of manufacturing a snap fastener system, the method comprising:

providing a conductive first snap fastener portion in electrical and physical contact with a first electrical component;

providing a second snap fastener portion snap mateable to the first snap fastener portion;

providing a snap ring including one or more tines mated to one of the first and/or second snap fastener portions about a fabric and including one or more conductive insulation displacement tines which pierce through the fabric and which cut through the insulation covering a wire to be electrically coupled to the first electronic component; and providing overlay tape to a circumferential edge of the second snap fastener portion configured to be received by a vacuum pickup system.

28. A snap fastener system comprising:

a conductive male snap fastener portion having top portion in electrical and physical contact with a first electronic component and a friction fit central stud extending from the top portion;

a female snap fastener portion including a central socket receiving the friction fit central stud therein; and a snap ring including tines mated to the female snap fastener portion and including one or more conductive insulation displacement tines which cut through the insulation covering a wire to be electrically coupled to the first electronic component via the one or more conductive insulation displacement tines, the female snap fastener portion, the friction fit central stud, and the male snap fastener top portion.

29. A snap fastener system comprising:

a conductive female snap fastener portion in electrical and physical contact with a first electronic component and including a central socket;

a male snap fastener portion including a central, stud received in the central female snap fastener portion socket; and a snap ring including tines mated to the male snap fastener portion and including one or more conductive insulation displacement tines which cut through the insulation covering a wire to be electrically coupled to the first electronic component via the one or more conductive insulation displacement tines, the male snap fastener portion stud, and the female snap fastener portion.

* * * * *